United States Patent [19]

Boyd et al.

[11] 4,430,601

[45] Feb. 7, 1984

[54] SELECTIVE SHIFTING AC PLASMA PANEL

[75] Inventors: Gary D. Boyd, Rumson; Peter D. T. Ngo, Colts Neck, both of N.J.

[73] Assignee: Bell Telephone Laboratories, Incorporated, Murray Hill, N.J.

[21] Appl. No.: 365,252

[22] Filed: Apr. 5, 1982

[51] Int. Cl.[3] ..... H05B 41/00

[52] U.S. Cl. ..... 315/169.4; 313/631; 315/169.2

[58] Field of Search ..... 315/169.2, 169.4; 340/768, 769, 792; 313/631

[56] References Cited

U.S. PATENT DOCUMENTS

| | | | |
|---|---|---|---|
| 3,823,394 | 7/1974 | Byrum, Jr., et al. | 365/116 |
| 4,009,415 | 2/1977 | Ngo | 340/714 |
| 4,030,091 | 6/1977 | Ngo | 340/771 |
| 4,097,780 | 6/1978 | Ngo | 340/771 |
| 4,104,626 | 8/1978 | Ngo | 340/768 |
| 4,336,535 | 6/1982 | Albertine, Jr. | 340/768 |

FOREIGN PATENT DOCUMENTS

| | | | |
|---|---|---|---|
| 1439533 | 6/1976 | United Kingdom | 315/169.2 |

*Primary Examiner*—Eugene R. LaRoche
*Attorney, Agent, or Firm*—John Francis Moran

[57] ABSTRACT

An AC plasma panel display (100) is described with selective row and column shifting capability. The column conductors ($C_2$, $C_4$ . . . , $C_{512}$) are common between a staging area (11) and an exhibiting area (12) while the other column conductors ($C_1$, $C_3$ . . . , $C_{511}$) are terminated at the boundary between the two areas. The row shifting is accomplished in the staging area to enter display data on the panel. Column shifting is used between the two areas to transport display data onto the exhibiting area from the staging area. The modified display panel requires a minimum number of drivers and intrinsically isolates column and row shifting during operation.

8 Claims, 18 Drawing Figures

| FIG. 1 | FIG. 2 |
|---|---|

FIG. 6

| CONDUCTOR GROUPS / SHIFTING INTERVALS | φ4 | φ3 | φ2 | φ1 | C2 |
|---|---|---|---|---|---|
| a | | NW | P, SW | X, E, Cc | |
| b | P, SW | X, E, C | Nc, Cc | | CW |
| c | NW | P, SW | X, E, Cc | | |
| d | X, E, Cc | Nc, Cc | | P, SW | X, E, Cc |
| e | P, SW | X, E, Cc | | NW | CW |
| f | Nc, Cc | | P, SW | X, E, Cc | |
| g | X, E, Cc | | NW | P, SW | X, E, Cc |
| h | | P, SW | X, E, Cc | Nc, Cc | |
| a | | NW | P, SW | X, E, Cc | |

FIG. 14 (UPWARD SHIFTING)

FIG. 15

UPWARD SHIFTING

| PHASE TRANSFER | GROUPS / INTERVALS | | φ1c | φ2c | φ3c | φ4c | A2 | | φ1R | φ2R | φ3R | φ4R | SR1 TO SR4 |
|---|---|---|---|---|---|---|---|---|---|---|---|---|---|
| 1-2 | a | | PSr, Rr SWr, NSr | | PSr, Rr SWr, NSr | | | | X,E,C | P,SW | NW | | |
| 3-4 | b | | | | | | | | | Nc, Cc | X,E,C | P, SW | |
| 2-3 | c | | | | | | | | | X,E,C | P,SW | NW | |
| 4-1 | d | | | | | | | | P,SW | | Nc, Cc | X,E, Cc | |
| 3-4 | e | | | | | | | | NW | | X,E,C | P, SW | |
| 1-2 | f | | | | | | | | X,E,Cc | P,SW | | Nc,Cc | |
| 1-4 | g | | | | | | | | P, SW | NW | | X, E, Cc | |
| 2-3 | h | | | | | | | | Nc, Cc | X,E,Cc | P,SW | | |
| 1-2 | a | | | | | | | | X,E,Cc | P,SW | NW | | |
| | INITIAL CORRESPONDENCE | | | | | | | | ODD DISPLAY | ODD TRANSFER | EVEN DISPLAY | EVEN TRANSFER | |

SELECTIVE SHIFTING AC PLASMA PANEL

BACKGROUND OF THE INVENTION

This invention relates to an ac plasma display requiring a reduced amount of driver circuitry and, more particularly, to such a display having selective horizontal and vertical shifting capability.

A plasma panel is a display device comprised of a body of ionizable gas sealed within a nonconductive, usually transparent envelope. Alphanumerics, pictures, and other graphical data are displayed by controllaby initiating glow discharges (also referred to as "gas discharges") at selected locations (sites) within the display gas. This is accomplished by setting up electric fields within the gas via appropriately arranged electrodes, or conductors.

The invention principally relates to so-called ac plasma panels which have the conductors embedded within dielectric layers disposed on two opposing nonconductive surfaces, such as glass plates. Typically, the conductors are arranged in rows on one plate and columns orthogonal thereto on the other plate. The overlappings, or crosspoints, of the row and column conductors define a matrix of discharge cells, or sites. Glow discharges (the ON-site condition) are initiated at selected crosspoints under the control of, for example, a digital computer.

A priorly filed copending patent application of P. D. T. Ngo, known as Ser. No. 109,859, filed Jan. 7, 1980, now U.S. Pat. No. 4,328,489, is directed, inter alia, to a technique for providing self-shifting of the ON display sites of an ac plasma panel. In that application lateral shifting is accomplished using a four-phase technique operating in a manner to cause display site discharge transportation from an ON display site to a next adjacent site position. Using the four-phase technique, it is possible to connect together each fourth column conductor, resulting in the use of only four column drivers as opposed to one driver for each column conductor. This technique requires a separate driver for each of the row conductors. In a typical visual display pattern, each pattern includes a 13-row by 9-column matrix for each of 39 character lines which totals 507 row conductors each requiring driver circuitry.

Another approach involves utilizing a plasma panel with a lower staging area for receiving input display data and an upper viewing, or exhibiting, area with both areas sharing common vertical conductors is disclosed in another copending patent application of P. D. T. Ngo, Ser. No. 307,169, filed Sept. 30, 1981. The upper viewing area shares four row drivers in a multiplexed shifting arrangement. However, this requires additional circuitry to apply signals to produce an electric field advanced in time in that section of the panel to prevent lateral shifting.

It would be highly desirable to have a plasma panel which possesses both a staging area and an exhibiting area yet is capable of being driven by a minimum number of drivers without the necessity of additional circuitry to prevent shifting of the ON sites in the viewing area.

SUMMARY OF THE INVENTION

Selective display site propagation on a plasma panel display has been achieved by modifying the conductors which form its gridlike matrix.

The modification involves terminating alternate ones of the conductors at the boundary between a staging area and an exhibiting area. The remaining conductors extend between the two areas and are common to provide display site propagation by shifting between the two areas. The absence of the terminated conductors in the exhibiting area keeps the position of the display data constant as new display data is shifted onto the staging area.

In some further aspects of the invention, alternate ones of the conductors being terminated are column conductors while the remaining column conductors extend from the staging area to the exhibiting area. The staging area extends laterally at the bottom of the display panel while the exhibiting area is adjacent to and located above the staging area.

BRIEF DESCRIPTION OF THE DRAWING

FIG. 6 is a chart for illustrating the lateral shifting signal sequence.

FIG. 15 is a chart of the signal sequence for upward site shifting.

DETAILED DESCRIPTION

Figure 1:
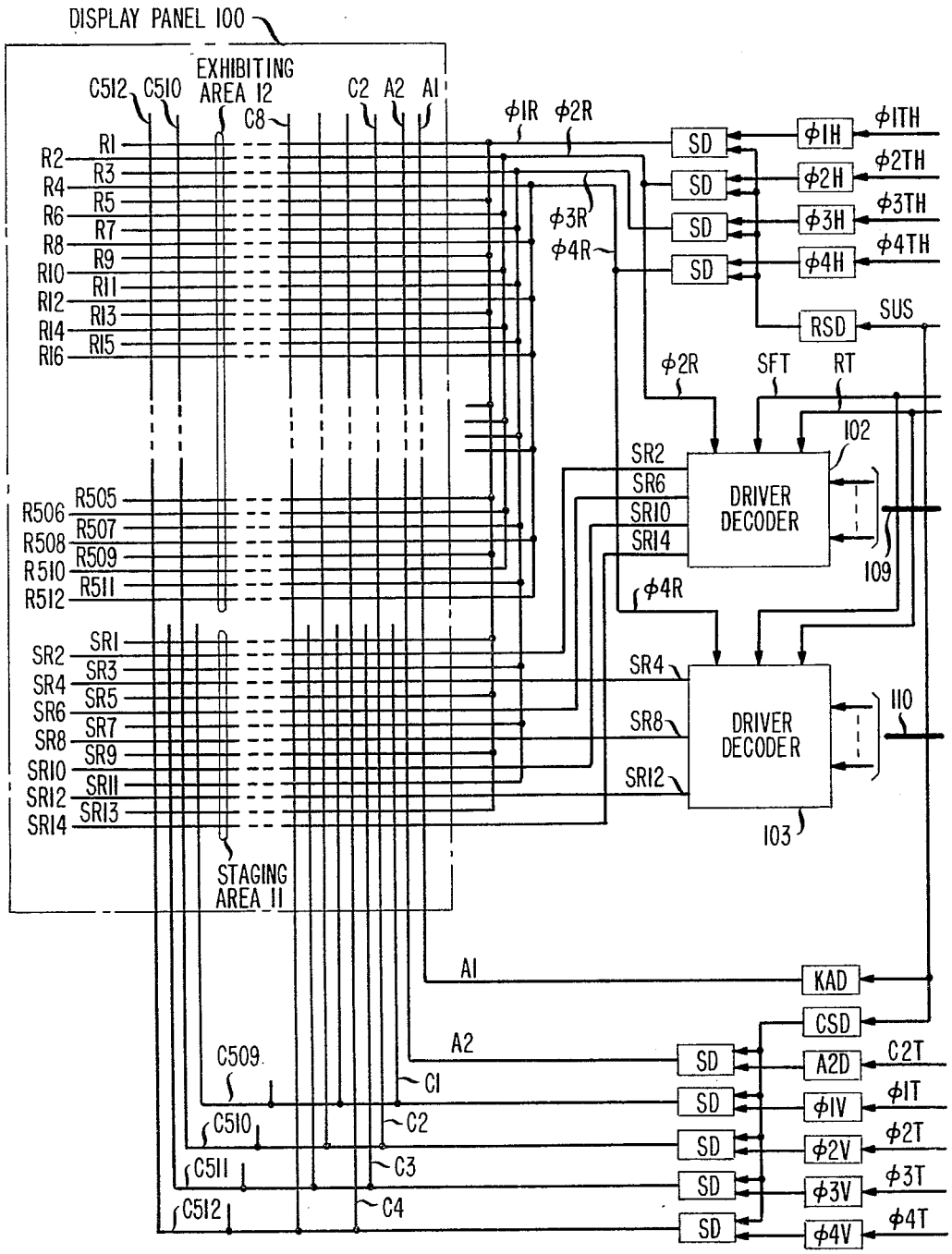
FIGS. 1 and 2 depict an ac plasma display system which includes circuitry for implementing the selective shifting technique of the present invention.
Figures 2, 3:
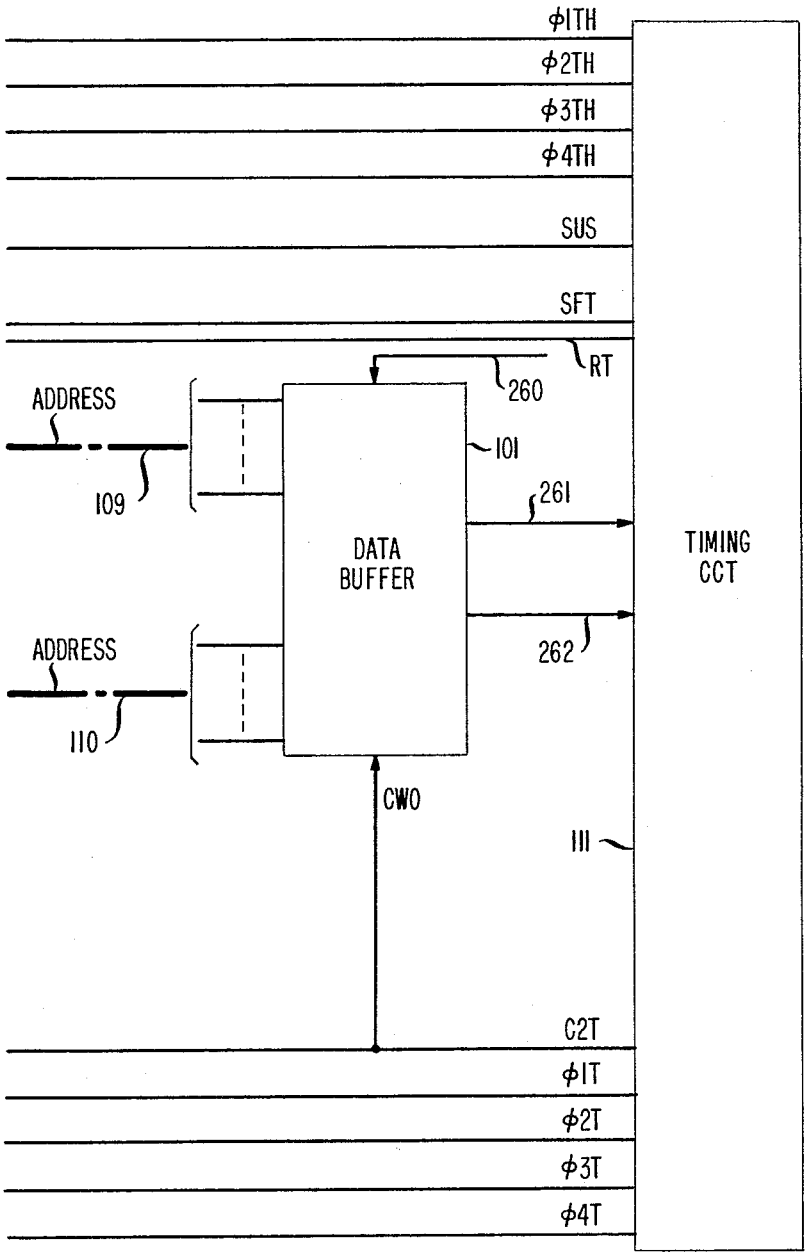
FIG. 3 shows how FIGS. 1 and 2 should be arranged.

At the heart of the display system of FIGS. 1 and 2 arranged according to FIG. 3 is a twin-substrate ac plasma display panel 100. Panel 100 is illustratively comprised of two glass plates between which an ionizable gas mixture is sealed. The inner surface of each glass plate is covered by a dielectric layer. A first set of even column conductors, C2, C4, C6 . . . , C512, is embedded in one of the dielectric layers in a generally vertical direction. A second set of 512 row conductors, R1–R512, is embedded in the dielectric layer in a generally horizontal direction. These conductors combine with the column conductors to form sites of exhibiting area 12. A third set of row conductors, for convenience called the staging row conductors, SR1–SR14, are embedded in the bottom section of the display in the same dielectric layer as are row conductors R1–R512. Interleaved between the even colum conductors, odd column conductors C1, C3, C5 . . . ,C511 are present only within staging area 11. These staging row conductors are in the horizontal direction and combine with the column conductors both odd and even to form the sites of staging area 11.

The staging area may be placed anywhere on the panel, within or outside of the viewing area and may be arranged to operate left to right or right to left. Also the staging area may extend in a generally vertical orientation and be placed to the left or right of the exhibiting area and either within or outside the viewing area. In other embodiments there may be several independent staging areas, some of which may be used for storage of data scrolled off the viewing area. Such an arrangement would be useful for forward and reverse scrolling.

The conductors of the set in staging area 11 are spaced at, for example, 60 lines per inch. The individual regions of panel 100 defined by the overlappings, or crosspoints, of the various row and column conductors are referred to as discharge sites. Visual data are presented on the panel by creating glow discharges in the gas at selected crosspoints. Panel 100 is illustratively of the general type, save the distinct conductor arrangement, disclosed in U.S. Pat. No. 3,823,394 issued July 9, 1974, to B. W. Byrum et al, which is hereby incorporated by reference. In exhibiting area 12, the row conductors have the same spacing as in staging area 11 but the column conductors are spaced twice as far apart as the column conductors in the staging area.

Most ac plasma panel systems use conventional write and erase pulses to switch OFF sites to the ON state and vice versa. The following discussion of the characteristics and operation of such pulses will be found helpful in understanding some of the basic principles of ac plasma panel operation.

Figure 4:
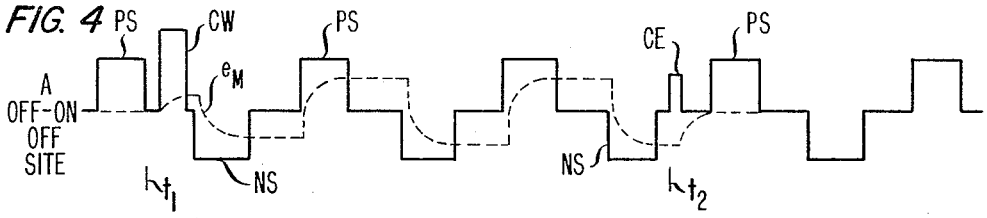
FIG. 4 depicts a signal waveform comprised of conventional ac plasma panel write, erase and sustain pulses.

Waveform A of FIG. 4 depicts a typical conventional write pulse CW. This pulse, shown as beginning at a time $t_1$, is impressed across (applied to) a selected discharge site of an ac plasma panel via the row and column conductor pair associated with that site. The magnitude of pulse CW exceeds the breakdown voltage of the display gas and is thus sufficient to create an initial glow discharge in the gas in the immediate vicinity of the selected site. The glow discharge is characterized by (a) a short, e.g., one microsecond, light pulse in the visible spectrum, and (b) the creation of a plasma, or "space charge cloud", of electrons and positive ions in the vicinity of the site. Pulse CW pulls at least some of these so-called charge carriers to opposite walls of the discharge site, i.e., respective regions of the opposing dielectric surfaces near the crosspoint. Even when pulse CW terminates, a "wall" voltage $e_M$ remains stored across the gas in the cross-point region. This wall voltage plays an important role in the subsequent operation of the panel, as will be seen shortly.

A single short duration light pulse cannot, of course, be detected by the human eye. In order to provide a discharge site of an ac plasma panel with the appearance of being continuously light-emitting (ON, energized), further rapidly successive glow discharges and accompanying light pulses are needed. These are generated by a sustain signal which is impressed across each site of the panel via the conductor pair. As indicated in waveform A, the sustain signal is illustratively comprised of a train of alternating positive- and negative-polarity sustain pulses PS and NS, respectively. The magnitude of these sustain pulses is less than the breakdown voltage. Thus, the voltage across display sites not previously energized by a write pulse is insufficient to cause a discharge and those sites remain non-light-emitting.

However, the voltage across the gas of a previously energized discharge site comprises the superposition of the sustain signal with the wall voltage $e_M$ previously stored at that site. In particular, the wall voltage created by write pulse CW, for example, combines additively with the following negative sustain pulse NS. This combined voltage exceeds the breakdown voltage so that a second glow discharge and accompanying light pulse occur. The flow of carriers to the walls of the discharge site now establishes a wall voltage of negative polarity. Thus, the following positive sustain pulse PS creates another discharge and wall voltage reversal, and so forth.

As long as at least a particular minimum level of wall charge is stored in response to each of these initial sustain pulses, the wall charge level, and hence the magnitude of wall voltage $e_M$ will build up to a constant, steady-stage characteristic level. The sustain signal frequency is typically on the order of 40–50 kHz. Thus, the light pulses created in response to each sustain pulse are fused by the eye of the viewer and the site appears to be continuously light-emitting.

A plasma discharge site already in a light-emitting state is switched to a non-light-emitting (OFF, de-energized) state by removing its wall charge. This is accomplished by an erase pulse, such as conventional erase pulse CE, which begins at a time $t_2$. Again, this pulse is impressed across a particular site by way of its row and column conductor pair. Since positive pulse CE follows a negative sustain pulse NS, pulse CE causes a discharge at an ON site, just as a positive sustain pulse would have. Wall voltage $e_M$ begins to reverse polarity. However, erase pulse CE is of such short duration relative to a sustain pulse that the wall voltage reversal is terminated prematurely. In particular, it is terminated at a time when the wall voltage is less than the minimum necessary to foster further discharges. The discharge site is thus returned to a non-light-emitting state. Any residuum of wall voltage $e_M$ eventually disappears due to recombination of the positive and negative charge carriers and diffusion thereof away from the display site.

The shifting of information across panel 100 is achieved in accordance with the self-shift technique disclosed in the previously mentioned patent application, Ser. No. 109,859, filed Jan. 7, 1980, and hereby incorporated by reference, by applying the signals shown in waveforms B-J of FIG. 5 to the sites of the panel in accordance with the sequence of FIG. 6. Before these signals are described, however, an overview of the self-shift process which they implement will be presented with reference to FIGS. 5–14. Due to the novel conductor arrangement of panel 100, shifting occurs in staging area 11 in normal fashion but the display data present in exhibiting area 12 remains static for continuous viewing. The absence of the odd column conductors in exhibiting area 12 prevents the formation of a transverse electrical field gradient which occurs in staging area 11 to shift the display data thereon.

At any point in time, information is displayed on the panel via the energization of selected sites in alternate columns and rows of the plasma panel. The columns and rows in which information is being displayed at any point in time are referred to as "display sites".

This format is illustrated in FIGS. 7–14 which depict a portion of the display panel. By way of example, the characters, "A", "3", "2" and "Y" are presented for viewing. The staging area is blank. The characters "S" and "P" will be shifted in from right to left and are shown in each of FIGS. 8–13 in successive points in the shifting process. The individual sites are selectively energized during either phase 2 or phase 4 via driver decoders 102 and 103 from data provided by data buffer 101. The purpose of using only these two phases, and not phase 1 or phase 3 will become clear hereinafter. At this point it is sufficient to understand that ON sites will be created by the coincidence of a voltage pulse on a column conductor A2 and a row conductor SR1–SR14. The sites in the column defined by conductor A1 are conventional, always-ON, keep-alive sites. These need not be discussed in further detail except to note that in practice, there are typically several lines of keep-alive sites on each side of the panel rather than the one line of keep-alive sites shown in FIGS. 7–14.

Figure 12:
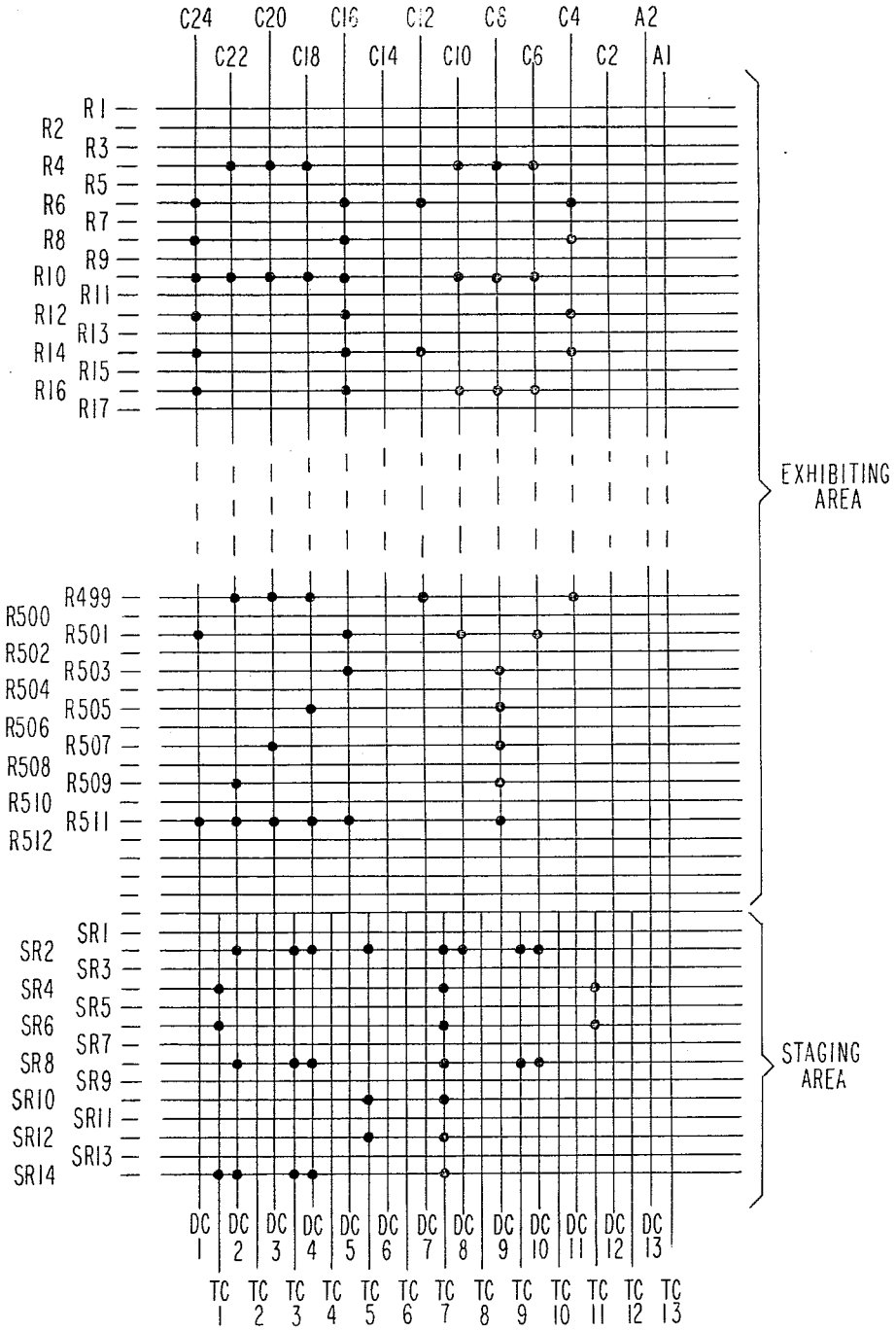
Figure 13:
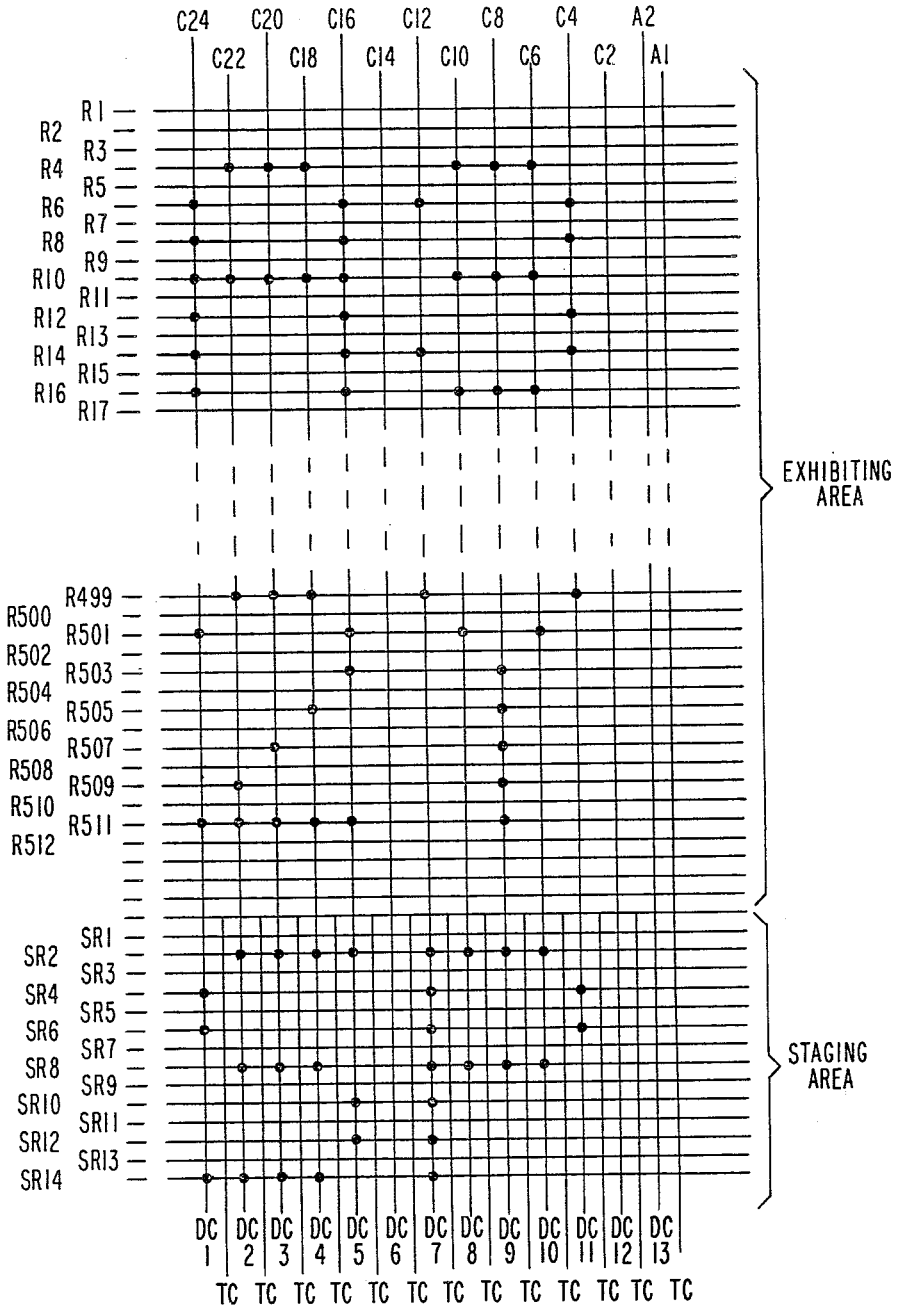

It is convenient to assign reference characters not only to the spatially fixed column conductors of the panel, i.e., C1–C512, but also to the spatially non-fixed columns of the displayed image. In particular, the column of display sites in which the ON sites reside at any fixed interval of time are called, for convenience, display sites and are designated DC-. Thus, as shown in FIG. 13 the left-most portion of the character "S" resides in column C24 which is designated DC1 for discussion purposes. The transfer column (column C23) to its right is designated TC1. The display and transfer columns to the immediate right of column DC1 are respectively designated DC2 and TC2, and so forth. Since these designations refer to columns in the displayed image (as opposed to the fixed column conductors), the character "S", for example, always appears in columns DC1–DC5, even though it appears at different ones of the column conductors C1–C512 as the "S" is shifted across the panel. This shifting process is depicted in FIGS. 9–12 where the "S" and "P" are laterally shifted across the staging area while the priorly positioned "A", "3", "2" and "Y" are maintained in a fixed position within the designated exhibiting area.

It will be noticed that only alternate columns and rows are used to carry displayed information. This format is not a requirement or limitation of the present invention, but is employed in this embodiment to provide a pleasing aspect ratio for the displayed characters. It should be noted that interleaved conductors are generally required for shifting display information between the alternate conductors which carry the displayed information.

As detailed in the above-identified copending patent application and as reviewed below, the characters on panel 100 are shifted one column to the left in a two-step process. In the first step, the states of the sites in one of the sets of display columns-illustratively the even display columns TC4, TC2, etc., of FIG. 12 are shifted along their respective rows to the sites in the odd transfer columns DC4, DC2, etc. The resulting pattern of ON sites is shown in FIG. 12. The states of the sites in the other set of display columns, i.e., the even display columns DC2, DC4, etc., are then shifted in the second step along their respective rows to the even transfer columns TC2, TC4, etc. As shown in FIG. 13, this completes the desired one-column shift to the left. The displayed characters may be shifted as far to the left as desired by repeating the two-step process.

Figure 5:
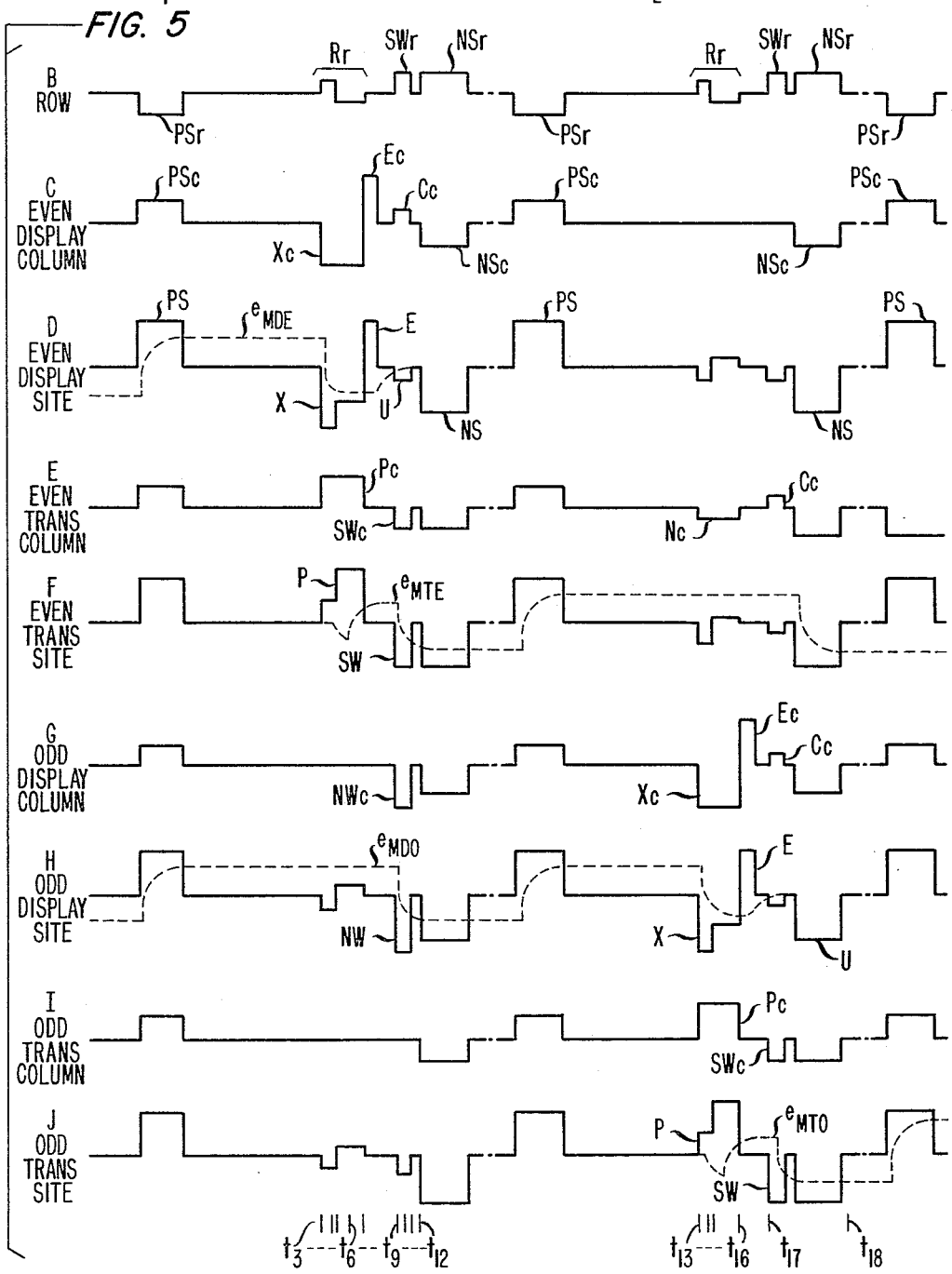
FIG. 5 illustrates several signal waveforms utilized in the display system of FIGS. 1 and 2 for providing lateral site shifting.
Figure 7:
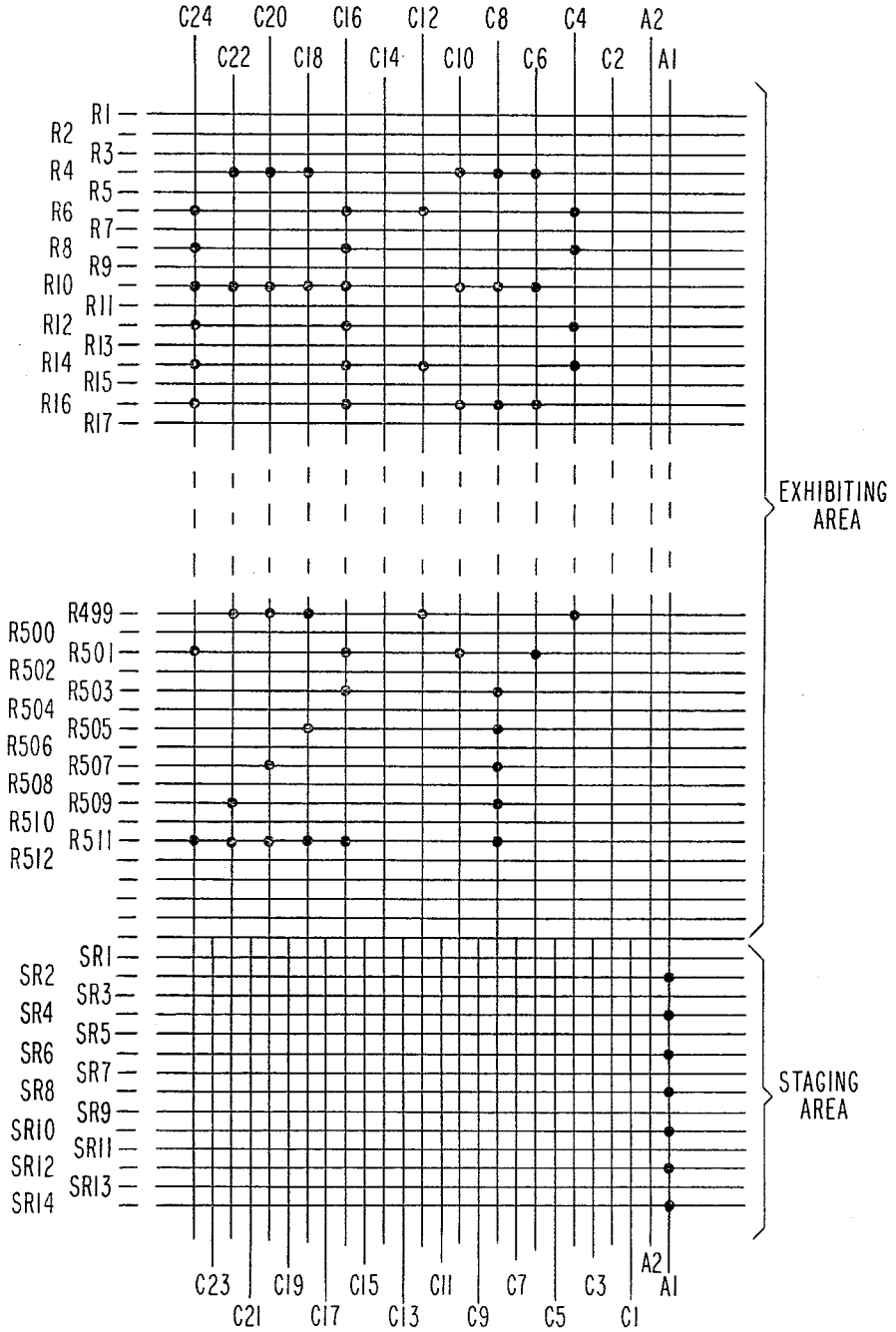
FIGS. 7–13 depict lateral site shifting operation on a plasma panel.
Figure 8:
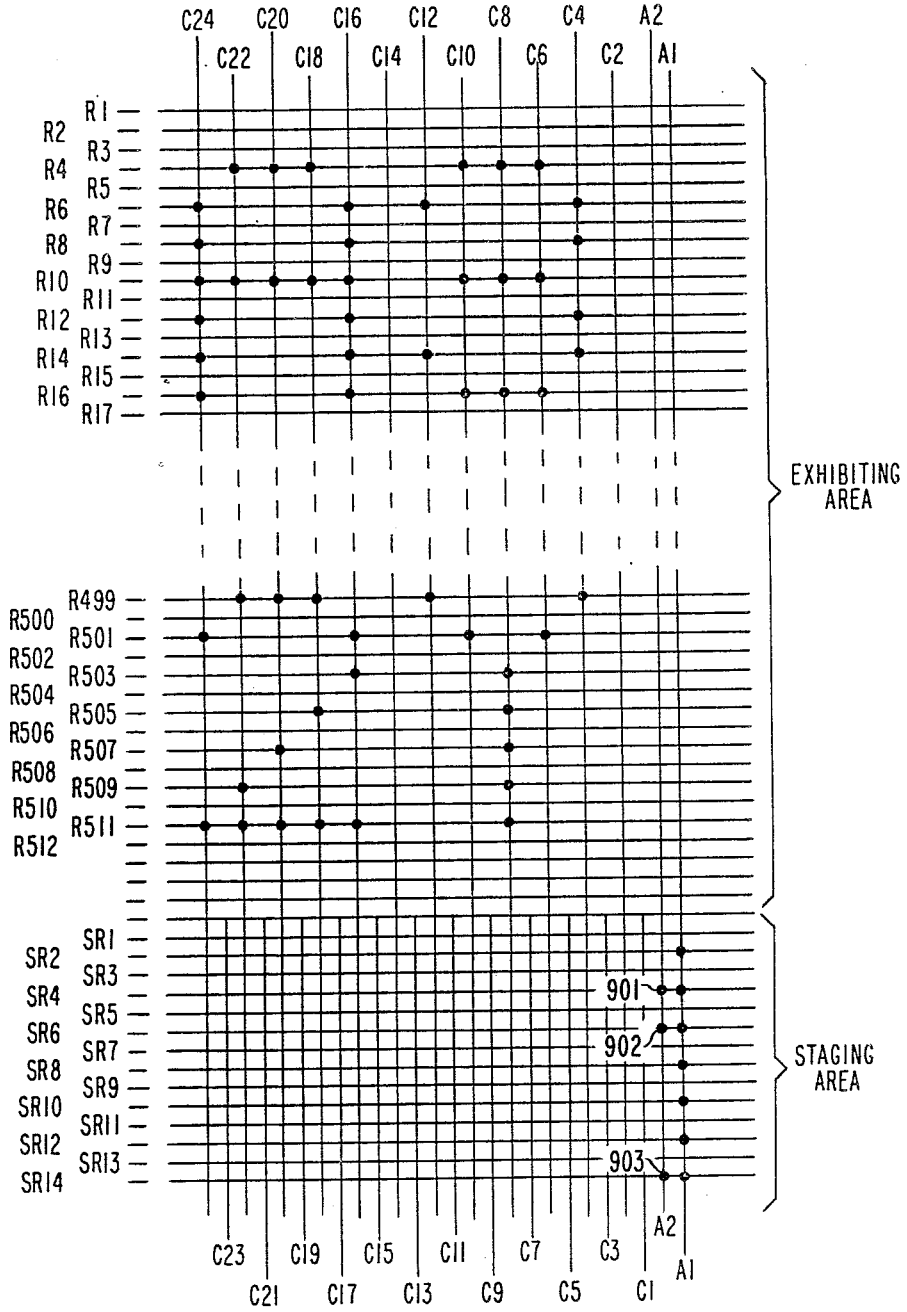
Figure 9:
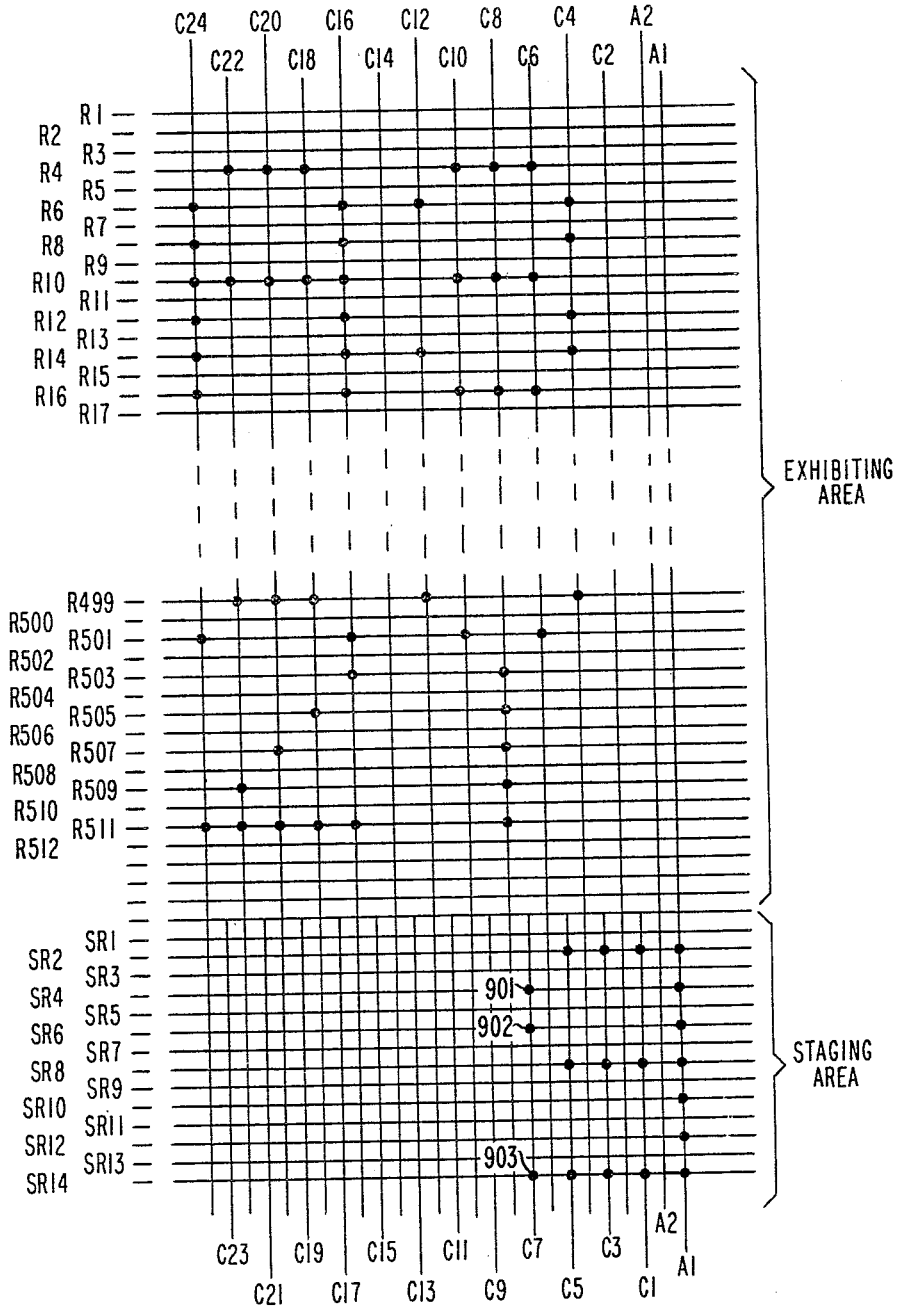
Figure 10:
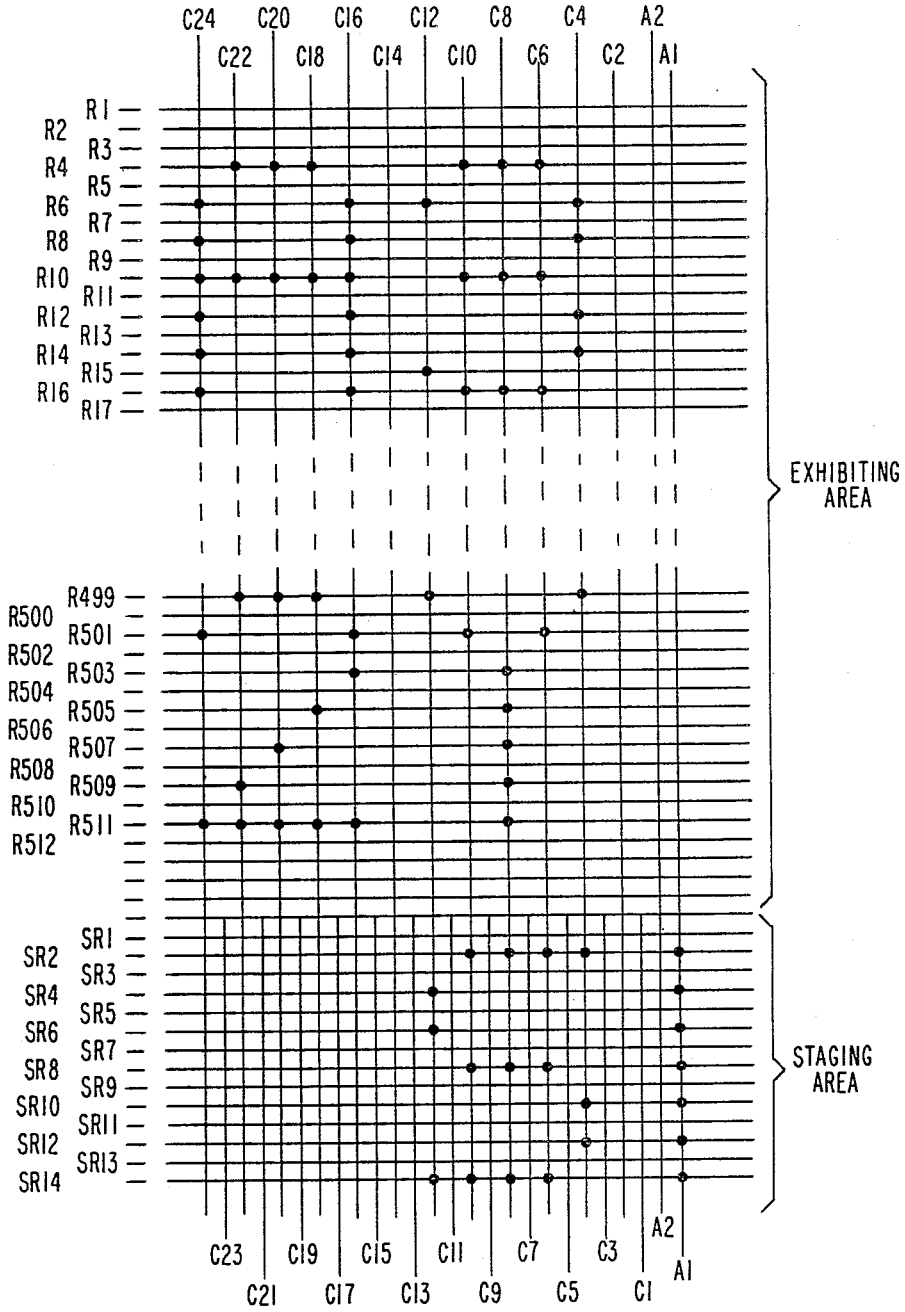
Figure 11:
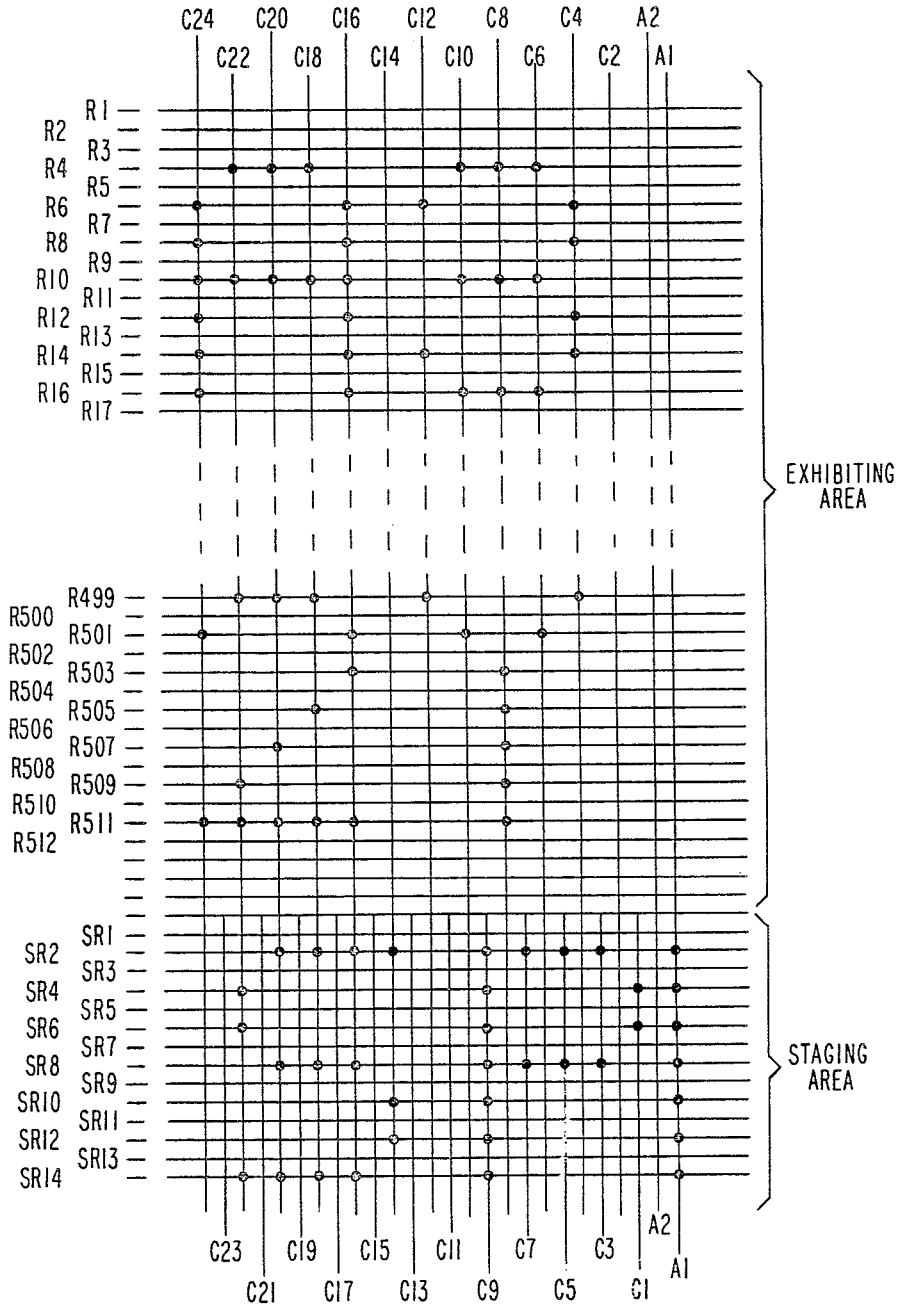

The use of the signals in waveforms B-J, FIG. 5, to achieve the above-described shifting operation will now be explained with reference to that portion of panel 100 defined by row conductor SR2 and column conductors C6–C22, shown in FIG. 12. The last sustain pulse applied to panel 100 is assumed to have been positive, voltages being measured from the column conductors to the row conductors. Thus, the negative, electron component of the wall charge stored at each ON site is adjacent to the dielectric layer containing the column conductors, while the positive, ion component is adjacent to the opposite dielectric layer containing the row conductors. Reference is made to waveforms B-F of FIG. 5. The shifting of the states of the even display sites to their respective transfer sites begins by impressing an excitation pulse X across the even display sites and concurrently, i.e., in time coincidence, impressing a priming pulse P across the even transfer sites. These pulses begin at time $t_3$ and terminate at time $t_7$. Pulses X and P have a common row component Rr, shown in waveform B. Their column components, Xc and Pc, are shown in waveforms C and E, respectively. Pulses X and P themselves are shown in waveforms D and F, respectively. Waveform D also shows the wall voltage $e_{MDE}$ of ON even display sites.

Figure 14:
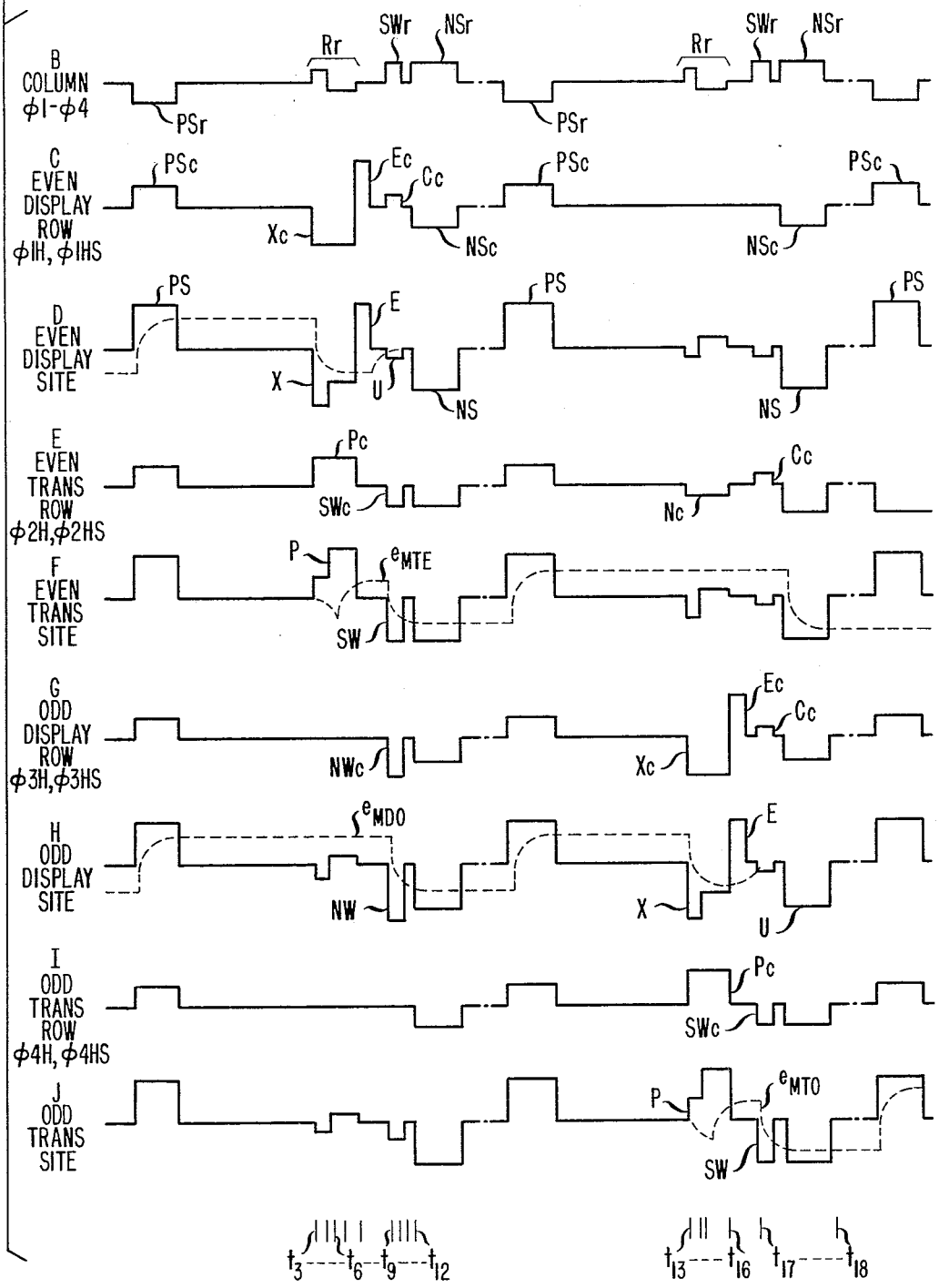
FIG. 14 illustrates signal waveforms utilized to provide upward site shifting on a plasma panel.
Figure 16:
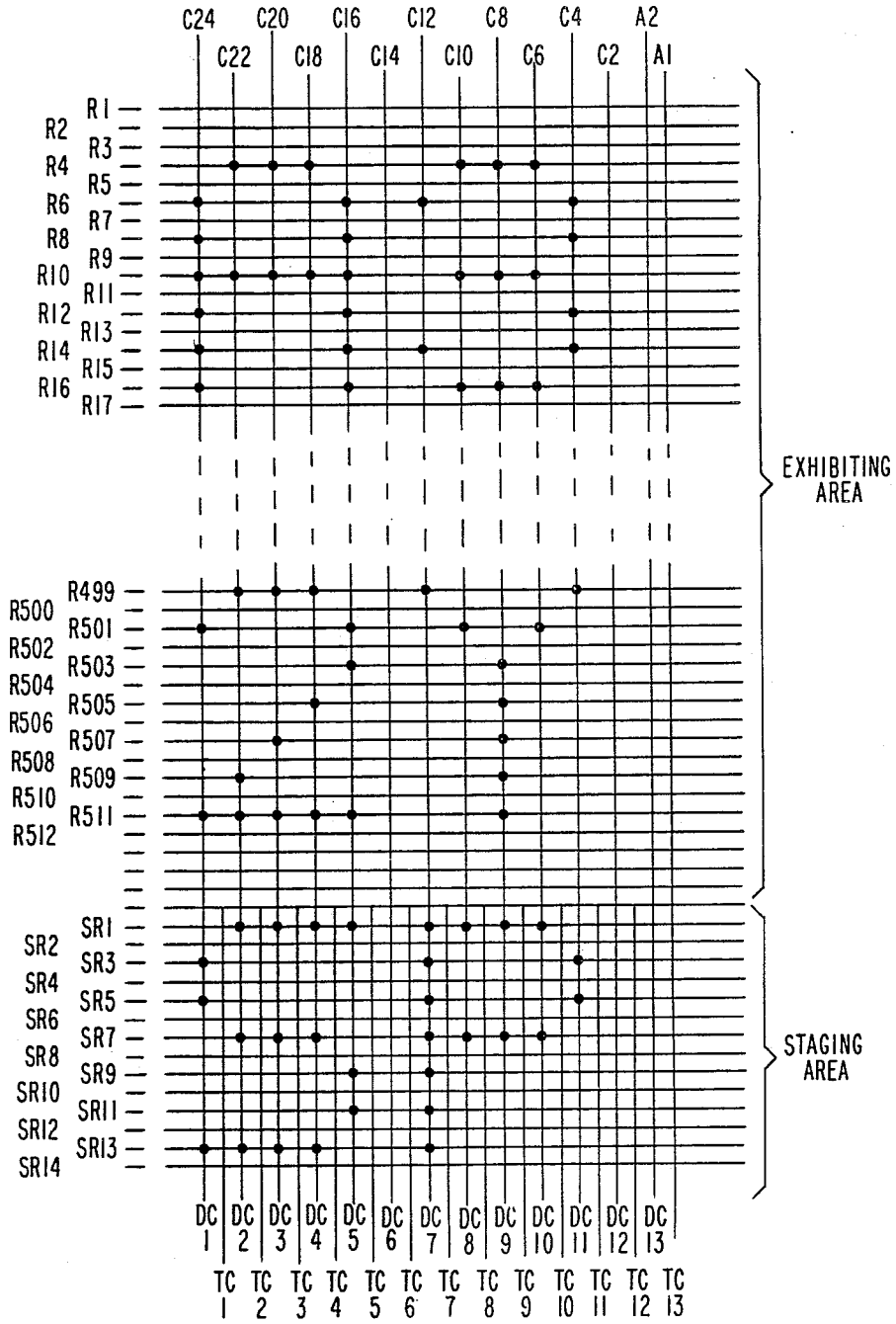
FIGS. 16–18 depict upward site shifting on a plasma panel.
Figure 17:
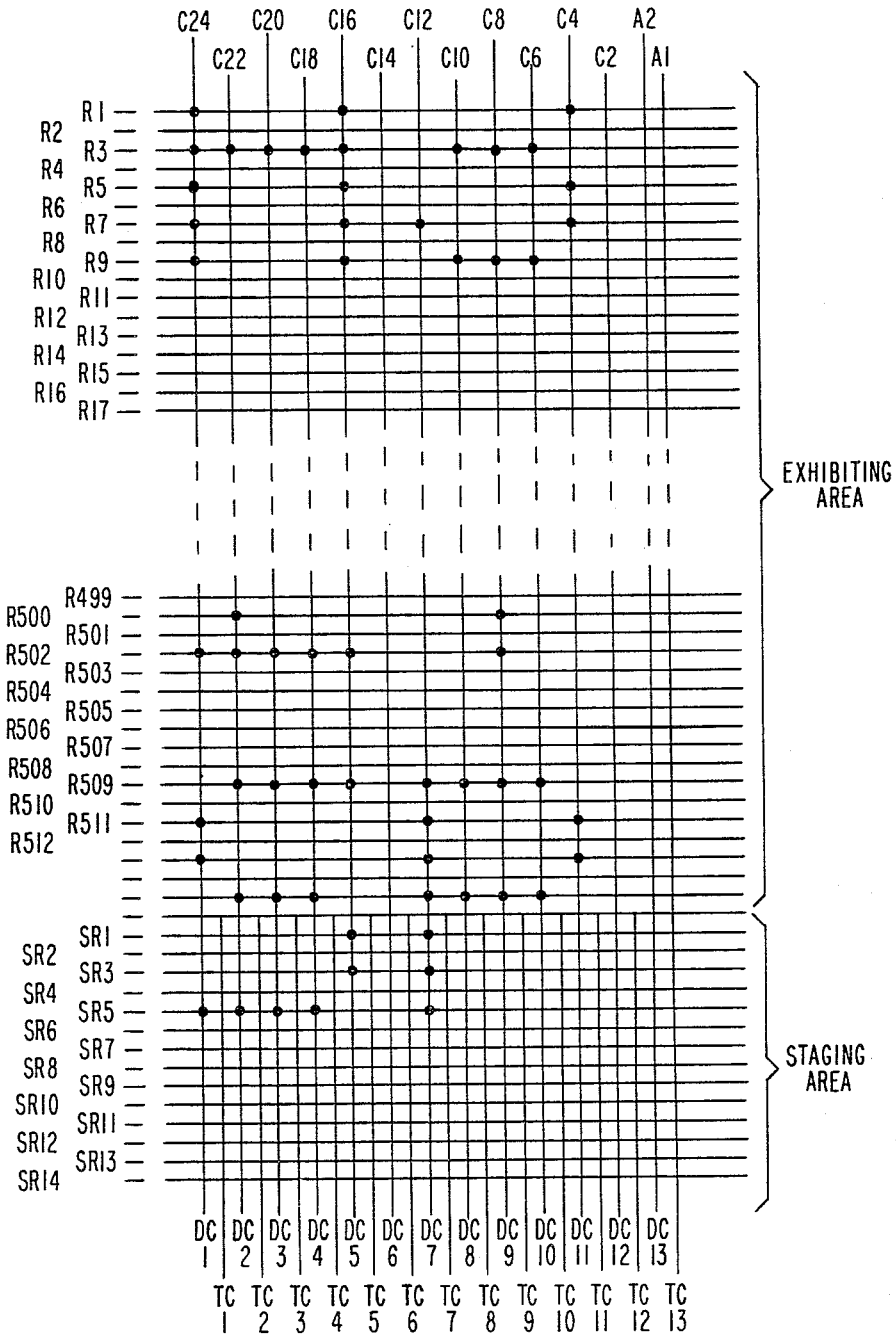
Figure 18:
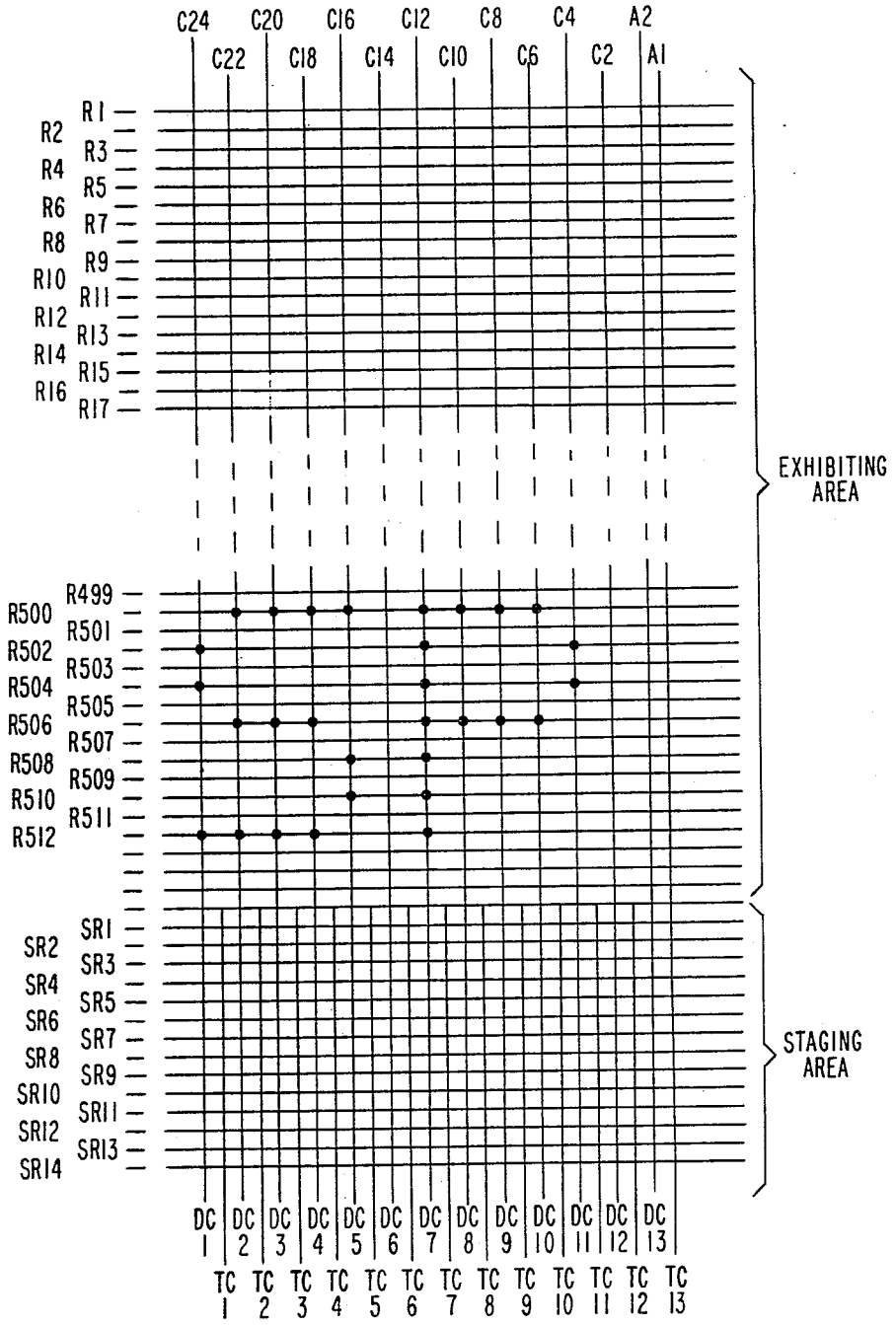

FIGS. 7–13 illustrate the creation of an "S" followed by the creation of a "P" with both being laterally shifted to the left and positioned directly under the priorly provided "A", "3", "2" and "Y". It should, of course, be understood that such an alignment is not necessary and the information provided to the staging area can be shifted to any position within the staging area. Once positioned where desired, the ON sites are then shifted upward, as illustrated in FIGS. 16–18. This upward shifting is accomplished by using the four phase technique discussed previously with the difference being that the row conductors are used for the transporting pulses in sequencial fashion. The sequence of pulses for this operation is shown in FIG. 15, and the waveforms are shown in FIG. 14.

A review of FIGS. 13 and 16 will show that for one phase the staging area ON sites move upward from the even rows to the odd rows while the viewing area ON sites remain constant. On subsequent phases, as shown in FIGS. 16–18, all of the ON sites in both the staging and viewing areas move upward together. Since the conductor arrangement of panel 100 extends alternate columns between staging area 11 and exhibiting area 12, the ON-SITES in the exhibiting area may occupy either the even or the odd rows, or both, as desired.

More particular reference is now made to the display system of FIG. 1. In addition to display panel 100, the system includes timing circuit 111, data buffer 101, row and column sustain drivers RSD and CSD, respectively, upward shift row drivers $\phi$1H–$\phi$4H, column A2 driver A2D, keep-alive driver KAD, column shift drivers $\phi$1V–$\phi$4V, and steering diode, i.e., OR gates SD. The above-mentioned drivers may all be similar to the type disclosed, for example, in U.S. Pat. No. 3,754,230 issued Aug. 21, 1973, to E. P. Auger. Data buffer DB may be similar to that shown, for example, in FIGS. 9–10 of U.S. Pat. No. 3,292,156, issued Dec. 13, 1966, to N. H. Stockel. Timing circuit 111 may be of the general type disclosed in U.S. Pat. No. 4,104,626 issued Aug. 1, 1978. The output signals of timing circuit 111 are described in one of the aforementioned copending patent applications and will not be repeated herein except as is necessary to provide a basis for understanding.

Beginning with column C1, every fourth column of panel 100 receives the same pulse sequence, as previously indicated. In particular, timing circuit 111 generates logic level signals within cable $\phi$1T, which define the times during each block of eight shifting intervals when pulses Cc and Nc and the column components of pulses X, E, P, SW and NW are to be applied to column conductors C1, C5, etc., by way of the associated one of gates SD. Conductors C2, C6, etc., similarly receive the output of driver $\phi$2V, while conductors C3, C7, etc., receive the output of driver $\phi$3V and conductors C4, C8, etc., receive the output of driver $\phi$4V. The signals received, and the pulses generated, by drivers $\phi$2V, $\phi$3V and $\phi$4V are the same as those of driver $\phi$1V, but are delayed two shifting intervals with respect to the previous one. To achieve this, appropriate timing signals for pulses Cc and Nc and for the column components of pulses X, E, P, SW and NW are provided to driver $\phi$2V via cable $\phi$2T.

In a similar manner, conductor A2 receives pulse Cc and the column components of pulses CW, X and E from driver C2D. The latter, in turn, is responsive to logic level signals via cable C2T.

The odd-numbered row conductors R1, R5, etc., receive row components Rr and SWr from row drivers $\phi$1H while row conductors R3, R7, etc., receive row components Rr and SWr from row drivers $\phi$3H. Drivers $\phi$1H and $\phi$3H generate those components in response to logic level signals on cables $\phi$1TH and $\phi$3TH. The timing signals on these cables define the time slots for the positive and negative portions of row component Rr. The timing signals also define the time slot for the row component of pulse SW (and thus of pulse NW).

A tap-off lead CW0 of cable C2T is explicitly shown in FIG. 2. This lead carries a signal during the time slot in which conventional write pulse CW is to be applied to the desired sites in the column defined by conductor A2. Lead CW0 extends to data buffer 101 which has a plurality of logic level output leads 109 and 110. The output of data buffer 101 are connected to driver decoders 102 and 103. Driver decoders 102 and 103 act as row drivers providing isolation between the rows while also allowing the associated rows to be controlled by a single signal. For example, a signal applied on input lead $\phi$2R would be applied to all row conductors SR2, SR6, SR10, and SR14, while inputs from cable 109 are only applied to the appropriate row conductor defined by the input signal.

Data buffer 101 responds to the signal on lead CW0 by providing logic level "1"s on individual ones of its output leads in accordance with the OFF and ON pattern to be presented in the write column, i.e., the column defined by conductor A2. The driver decoder, in response to receipt of a "1" extends the row half-select component CWr of pulse CW, to the proper row conductor. Since only column A2 receives the column half-select component CWc, the only sites affected by the row half-select component CWr are those sites in the write column which are to be switched ON.

Circuit 111 continuously provides the above-described timing signals on cable SUS during non-shifting periods to continuously generate the sustain signal necessary to maintain whatever sites are currently in the ON state in that state. At the same time, data buffer 101 receives, over lead 260, new information to be shifted onto the panel. Lead 260 may extend from a digital computer, for example, or other data processor.

When shifting is to commence, buffer 101 provides a logic level "1" to timing circuit 111 over lead 261. The latter, in response, begins to generate the sequence of logic level signals necessary to generate the pulse sequence of FIG. 4. Whenever the buffer is empty, the signal on lead 261 returns to "0". Circuit 111 continues in the shifting mode through the next-occurring one of shifting intervals d or h and then returns to the pure sustain mode. Then information stored in the staging area of panel 100 will be sustained until removed.

Upward shifting of the information stored in the staging area of panel 100 can begin automatically at the conclusion of the shifting interval under control of timing circuit 111 or it may advantageously move upward under control of information supplied via data buffer 101 via lead 262. This information could be a simple command to move the display upward a fixed amount or the information can specify how many phases upward the visual image is to be moved.

From an understanding of the foregoing it will be understood that two diverse criteria must be met for proper lateral and upward shifting. For upward shifting it is necessary that every fourth conductor be connected together since the phases are continuously repeating. In the exhibiting section of the panel this presents no difficulty. However, in the staging area the individual rows must be isolated so that ON sites may be created on any row. Thus, if each fourth row were to be electrically connected (as is necessary for upward transportation), then an attempt to turn an ON site on (for example, row SR2) would result in ON sites in rows SR6, SR10 and SR14. This problem is overcome, in one embodiment, by floating the ON-site generation signals on top of the phasing signals by using driver decoders 102 and 103 which advantageously can be Texas Instrument Decoder No. SN75501A.

The number of drivers and supporting control circuitry is greatly reduced by taking advantage of the fact that ON sites are, for good visual presentation, generated on alternate rows and alternate columns. Accordingly, there is no disadvantage for having only alternate columns present in exhibiting area. From a manufacturing standpoint, such a display panel is easier to make than the conventional panel. For upward shifting, since the staging area ON sites are on the even rows and the viewing area ON sites may be on the even or the odd rows, the start of the sequence which serves to move the staging area information upward one row is not critical, i.e., to even rows are not required as they are in the exhibiting area. On subsequent phases all of the information, both from the upper and lower areas move concurrently as shown in FIGS. 17 and 18.

It will thus be appreciated that the specific embodiment of the invention shown and described herein is merely illustrative. Those skilled in the art will be able to devise many and varied arrangements embodying the principles of the invention without departing from the spirit and scope thereof. For example, other staging areas can be arranged, either out of the visual area, or within the visual area, and images could be formed or stored, in many locations, even between the lines of the exhibiting area. Furthermore, although the invention is illustrated using the twin-substrate type of panel construction, it may also be utilized in a.c. driven single substrate panels wherein the electrode arrangement is capable of establishing a lateral field gradient.

What is claimed is:

1. A plasma panel display of the type being capable of charge cloud transportation in response to the output of driver circuitry for propagating the status of display data between site locations, said plasma display having at least a first conductor arrangement in a first portion of the panel and a second conductor arrangement in a second portion of the panel, the first and second portions having common continuous conductors extending between the two portions, and each conductor arrangement serving to provide selective propagation of the status of display data between site locations in its portion in a predetermined direction.

2. The plasma panel of claim 1 wherein each of the conductor arrangements serves to propagate the status of display data in predetermined directions orthogonal to each other.

3. The plasma panel of claim 2 wherein one of said portions is a staging area and the other of said portions is an exhibiting area.

4. A plasma panel display of the type having first and second orthogonally oriented conductors affixed to opposite sides enclosing an ionizable gaseous medium, said plasma panel comprising at least two areas each having a gridlike structure formed by the overlapping of first and second conductors, a first area having the first and the second conductors spaced apart at substantially regular intervals while the second area has the second conductors spaced twice as far apart as the first conductors, alternate ones of the second conductors in the first area continuously extending into the second area to be adjacent second conductors in the second area, the first area serving as a staging area for entering display data and the second area serving as an exhibiting area for receiving display data shifted thereon from the staging area whereby intrinsic selective shifting is provided in each area.

5. The plasma panel display of claim 4 wherein said first conductors are row conductors and said second conductors are column conductors.

6. The plasma panel display of claim 5 wherein the staging area extends laterally across said panel and the exhibiting area is adjacent to and above the staging area.

7. In a plasma panel display having an ionizable gaseous medium in a gas chamber formed by a pair of opposed dielectric charge storage members, the electrodes behind each dielectric member being appropriately oriented relative to the electrodes behind the opposing dielectric member so as to define a plurality of discrete discharge cells and the panel is divided into an inputting section and an exhibiting section wherein all first electrodes of the exhibiting section are oriented in a predetermined direction for continuously extending between the two sections to interleave with similarly oriented second electrodes in the input section, the inputting section accepts display information which shifts thereon and the exhibiting section is adapted to accept display information from the input section present at the cells of said first electrodes.

8. A plasma panel having a staging area and an exhibiting area wherein display data is capable of being shifted onto the staging area in a first direction to occupy a desired position and the display data in the staging area is shifted in a second direction orthogonal to the first direction to occupy a desired position in the exhibiting area, the panel is characterized in that of the electrical conductors which are oriented in the second direction in the staging area every other conductor is continuous and extends to the exhibiting area to be in common between both areas while interleaved electrical conductors in staging area are terminated at the boundary of the exhibiting area, the extended conductors serve as the only conductors oriented in said second direction in the exhibiting area.

* * * * *